US006928964B2

(12) United States Patent
Obermayer et al.

(10) Patent No.: US 6,928,964 B2
(45) Date of Patent: Aug. 16, 2005

(54) CYLINDER HEAD FOR A LIQUID-COOLED MULTI-CYLINDER INTERNAL COMBUSTION ENGINE

(75) Inventors: Bertram Obermayer, Hitzendorf (AT); Robert Pöschl, Graz-Andritz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/693,690

(22) Filed: Oct. 27, 2003

(65) Prior Publication Data

US 2004/0139933 A1 Jul. 22, 2004

(30) Foreign Application Priority Data

Oct. 31, 2002 (AT) ..... GM741/2002

(51) Int. Cl.[7] ..... F02F 1/36
(52) U.S. Cl. ..... 123/41.82 R
(58) Field of Search ..... 123/41.82 R, 193.5, 123/41.31, 41.74, 188.9

(56) References Cited

U.S. PATENT DOCUMENTS

| | | | | |
|---|---|---|---|---|
| 4,304,199 A | | 12/1981 | Formia et al. | |
| 4,889,080 A | * | 12/1989 | Oguri | 123/41.82 R |
| 6,681,727 B2 | * | 1/2004 | Krenn | 123/41.82 R |

FOREIGN PATENT DOCUMENTS

| | | |
|---|---|---|
| AT | 005301 | 5/2002 |
| CH | 614995 | 12/1979 |
| DE | 2460972 | 7/1976 |
| DE | 2514592 | 10/1976 |
| DE | 10202661 | 8/2002 |
| EP | 1126152 | 8/2001 |
| JP | 06074041 | 3/1994 |
| JP | 200310157 | 11/2000 |

* cited by examiner

*Primary Examiner*—Henry C. Yuen
*Assistant Examiner*—Hyder Ali
(74) *Attorney, Agent, or Firm*—Dykema Gossett PLLC

(57) ABSTRACT

A cylinder head for a liquid-cooled multi-cylinder internal combustion engine, with a cooling chamber configuration adjacent to a fire deck, which is partitioned by an intermediary deck essentially parallel to the fire deck into a lower cooling chamber in the direction of the cylinder axis, where lower and upper cooling chambers are flow-connected by at least one main transfer opening for each cylinder in the area of the side wall of the cylinder head and by at least one auxiliary transfer opening in the region of a preferably central opening for the insertion of a fuel injection device. At least one auxiliary transfer opening is configured as a recess in the insertion opening, and at least one first auxiliary transfer opening is located in at least one of the areas between intake passage and insertion opening and/or exhaust passage and insertion opening.

9 Claims, 2 Drawing Sheets

CYLINDER HEAD FOR A LIQUID-COOLED MULTI-CYLINDER INTERNAL COMBUSTION ENGINE

BACKGROUND OF THE INVENTION

The invention relates to a cylinder head for a liquid-cooled multi-cylinder internal combustion engine, with at least one intake-and at least one exhaust port per cylinder, and with a cooling chamber configuration adjacent to a fire deck, which cooling chamber is partitioned by an intermediary deck essentially parallel to the fire deck into a lower cooling chamber next to the fire deck and an upper cooling chamber adjoining the lower cooling chamber in the direction of the cylinder axis, where lower and upper cooling chamber are flow-connected by at least one main transfer opening per cylinder in the area of a cylinder head side wall and by at least one auxiliary transfer opening in the region of a preferably central opening for the insertion of a fuel injection device, and where at least one feeder inlet per cylinder for a cooling medium opens into the lower cooling chamber and at least one draining outlet for the cooling medium departs from the upper cooling chamber, and where a lower cooling chamber is provided for each individual cylinder, the lower cooling chambers of adjacent cylinders being essentially separated by a partitioning wall and the cooling medium flowing essentially transversely to the cylinder head in the lower cooling chamber, while the upper cooling chamber extends over at least two cylinders.

In the case of high-power diesel combustion engines with high heat generation a single contiguous cooling chamber for a cooling medium flowing lengthwise through the cylinder head will not be sufficient for effective cooling of the fire deck. Insufficient heat removal from the cylinder head may in turn lead to leaks, cracks and warping phenomena.

DESCRIPTION OF THE PRIOR ART

AT 005 301 U1 describes a cylinder head for a plurality of cylinders with an upper and a lower cooling chamber, with the cooling medium in the lower cooling chamber flowing essentially transversely to the cylinder head. The cooling medium on the one hand enters through an annular transfer opening into the insertion opening of a fuel injection device and on the other hand flows through lateral transfer openings in the area of a sidewall from the lower into the upper cooling chamber. Transversal flow cooling in the lower cooling chamber will achieve uniform cooling of the individual cylinders. The configuration has the disadvantage that specific cooling of thermally critical areas, for instance the area between two exhaust valves, is not possible and that areas with high thermal loads cannot be sufficiently cooled.

From CH 614 995 A a single-cylinder cylinder head for a diesel engine is known, which has a lower cooling chamber next to the fire deck and an upper cooling chamber, a partition wall being provided between lower and upper cooling chamber. Cooling liquid is fed via a feeder stub into ring-shaped cooling channels around the valve seats and also into the lower cooling chamber. From the cooling channels around the valve seats the cooling liquid flows into a central annular chamber which surrounds a sleeve for a fuel injection device. From there the cooling liquid flows into the upper cooling chamber. In this way the fire deck and the valve seats are to be cooled independently of each other. DE 24 60 972 A1 also lays open a single-cylinder cylinder head with two cooling chambers placed one above the other and communicating via openings. These configurations are not suitable for a cylinder head serving a multi-cylinder combustion engine.

From U.S. Pat. No. 4,304,199 A a cylinder head for a plurality of cylinders of a diesel internal combustion engine is known, having a cooling chamber which is partitioned by a partition wall into a lower and an upper cooling chamber. Lower and upper cooling chamber are flow-connected via a crescent-shaped opening, which partially surrounds the seat of an injection nozzle. The cooling liquid flows from the cylinder block via feeder inlets in the fire deck into the lower cooling chamber and from there via the crescent-shaped openings into the upper cooling chamber. The lower cooling chamber is designed to serve a multitude of adjacent cylinders, such that a longitudinal flow is at least partially realised. If heat input from the combustion chamber is high this arrangement cannot guarantee sufficient heat removal.

From EP 1 126 152 A2 a cylinder head with a lower and an upper cooling chamber is known, where the coolant flow between lower and upper cooling chamber takes place via an annular gap between the sleeve of a fuel injection nozzle and an intermediary deck, the total coolant flow taking place through this gap. This configuration also suffers from the disadvantage that specific cooling of thermally critical areas, for instance the area between two exhaust valves, is not possible and that "hot spots" are not sufficiently cooled.

JP 06-074041 A describes a cylinder head with a lower and an upper cooling chamber and a centrally located sleeve for a fuel injection nozzle. Immediately adjacent to this sleeve the intermediary deck is provided with a transfer opening in the area between two exhaust valves. The cooling liquid entering the lower cooling chamber flows radially towards the cylinder axis and via the single transfer opening into the upper cooling chamber, similar to the situation in EP 1 126 152 A2. No dominant transverse flow is achieved in the lower cooling chamber. While the area between the two exhaust valves is well cooled, other areas with high thermal loads, e.g. the area between the intake valves and the fuel injection device, do not receive sufficient cooling.

From JP 2000-310157 A a cylinder head for a multi-cylinder combustion engine with a cooling chamber extending around the exhaust passages and the sleeve for the fuel injection nozzle is known. The cooling medium flows from the cylinder block via a coolant bore into a lower region of the cooling chamber and enters an upper region of the cooling chamber via a cooling channel provided between the exhaust passage and the sleeve for the fuel injection nozzle. The cooling channel is not configured as a recess in the opening for insertion of a fuel injection device. Neither are the lower cooling regions of two cylinders separated by a partition wall nor is there achieved a pronounced transverse flow of coolant in this region. Areas subject to high thermal loads such as the areas between the gas exchange passages and the area of the fuel injection device in the fire deck are not sufficiently cooled.

SUMMARY OF THE INVENTION

It is the object of the present invention to improve cooling in a cylinder head of the type described above in as simple a manner as possible.

This object is achieved in the invention by providing that at least one auxiliary transfer opening is configured as a recess in the opening for the fuel injection device and that at least one first auxiliary transfer opening is positioned in at least one of the areas between intake passage and fuel injector opening and/or between exhaust passage and fuel injector opening. Thus efficient cooling of the area around the fuel injector opening is achieved. It is advantageous to manufacture the recess by casting, which will simplify the manufacturing process. In a preferred variant at least two auxiliary transfer openings are provided as recesses in the fuel injector opening, where at least a first auxiliary transfer opening is located in the area between exhaust passage and fuel injector insertion opening and at least a second auxiliary transfer opening is located in the area between intake passage and fuel injector opening. Thus critical areas may specifically receive coolant and particular "hot spots" may be optimally supplied with cooling liquid. Very efficient cooling may be achieved if at least two auxiliary transfer openings are placed diametrically opposite each other with respect to the insertion opening for the fuel injector.

The area between exhaust passage and fuel injector opening is subject to particularly high thermal load. Efficient heat removal from this area is of special importance. In order to achieve this it is provided that the first auxiliary transfer opening have a larger flow cross section than the second auxiliary transfer opening, the cross section of the first auxiliary transfer opening preferably being twice as large as the cross section of the second auxiliary transfer opening.

It is essential to reliably avoid film boiling in this area. Film boiling would lead to the forming of deposits which would impede heat transfer. In order to avoid film boiling high flow velocities are desirable in the area between exhaust passage and fuel injector opening.

Uniform cooling of the fire deck and optimum cooling of the areas between intake- and exhaust passages may be achieved by providing that only part of the coolant flow volume, i.e., preferably 20% to 40% of the total coolant volume passing through lower and upper cooling chamber, should flow through the at least one auxiliary transfer opening. In order to avoid film boiling it is of particular advantage if roughly two thirds of this partial coolant volume flow through the first auxiliary transfer opening while one third of the partial coolant volume flows through the second auxiliary transfer opening from the lower into the upper cooling chamber.

BRIEF DESCRIPTION OF THE DRAWINGS

The invention will now be explained in more detail with reference to the attached drawings, wherein.

DETAILED DESCRIPTION OF THE PREFERRED EMBODIMENT

Figure 1:
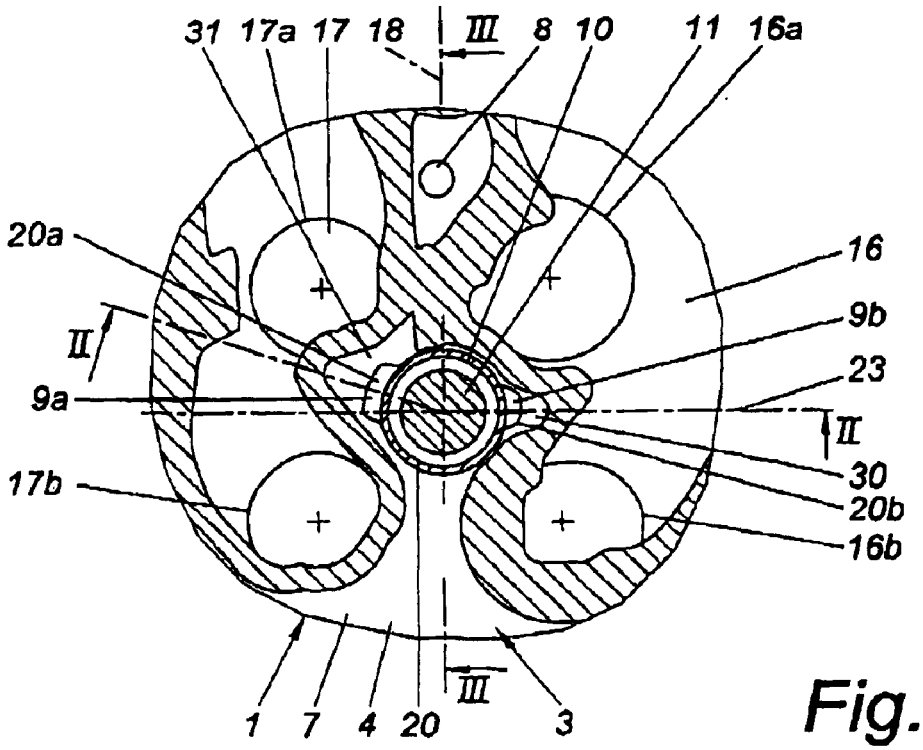
FIG. 1 shows a cylinder head in accordance with the invention, in a section along line I—I of FIG. 2.
Figure 2:
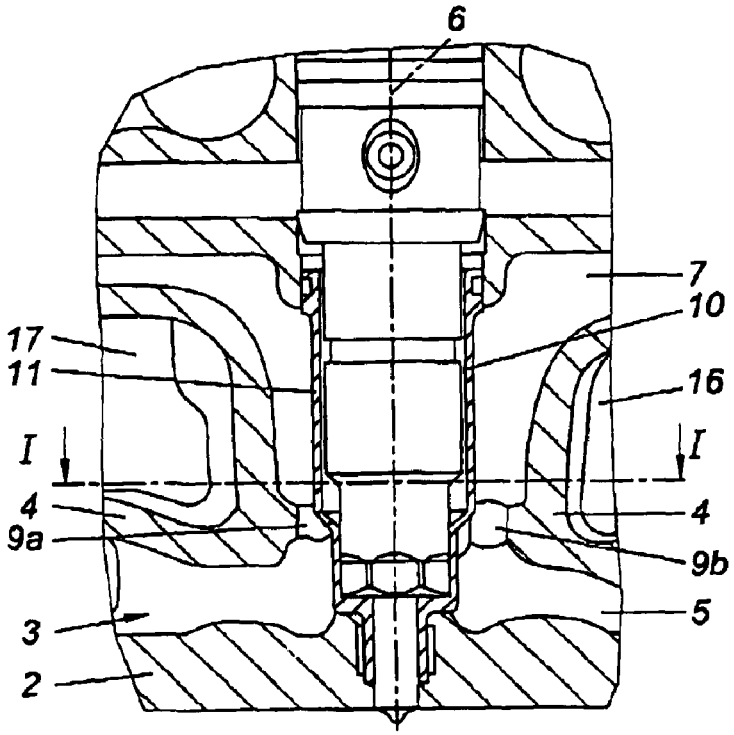
FIG. 2 shows the cylinder head in a section along line II—II of FIG. 1.
Figure 3:
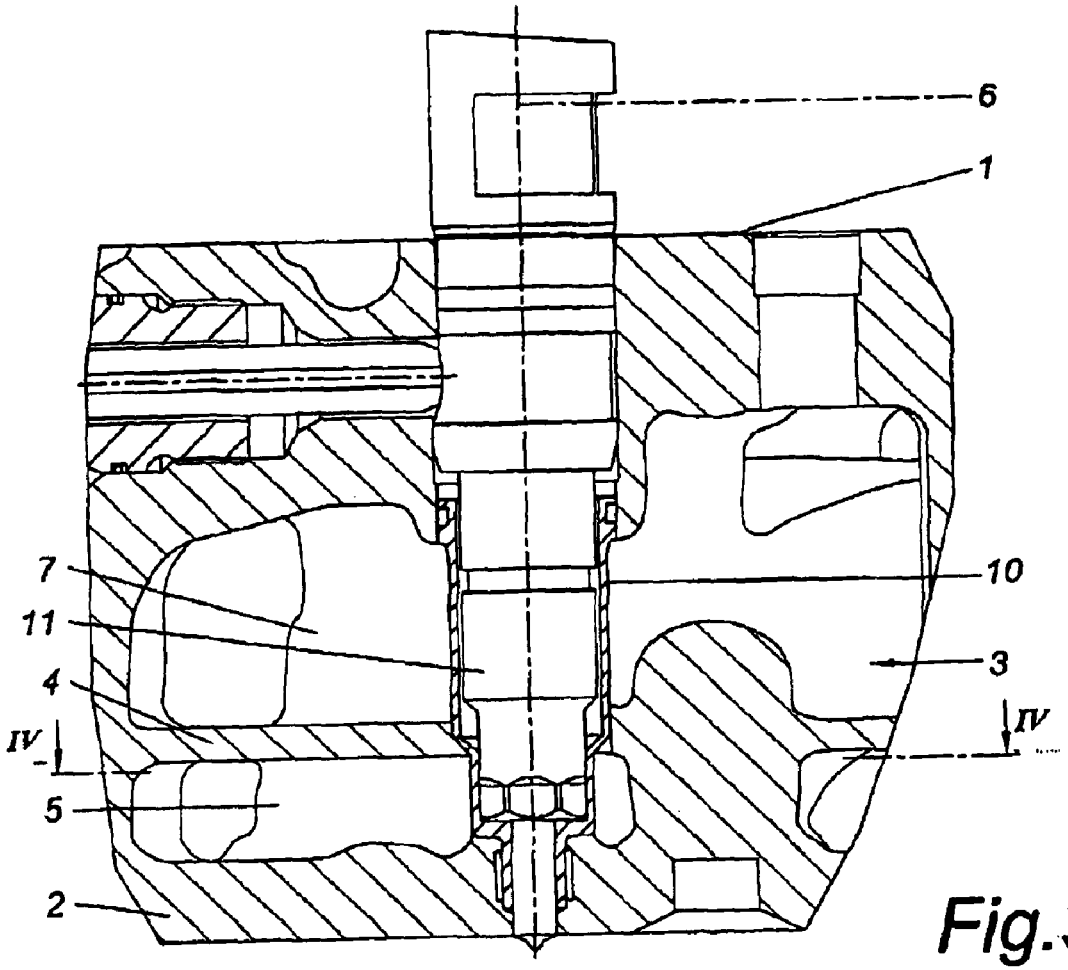
FIG. 3 shows the cylinder head in a section along line III—III of FIG. 1.

The cylinder head 1, which is configured in one piece for a plurality of cylinders A, B, is provided with a cooling chamber configuration 3 adjacent to a fire deck 2 next to the combustion chamber, which configuration 3 is partitioned by an intermediate deck 4 into a lower cooling chamber 5 next to the fire deck 2, and an upper cooling chamber 7 adjoining the lower chamber in the direction of the cylinder axis 6. The intermediate deck 4 has at least one auxiliary transfer opening 9*a*, 9*b* for each cylinder A, B in the vicinity of an insertion pipe 10, which is designed to receive a fuel injection device 11. Each auxiliary transfer opening 9*a*, 9*b* is configured as a recess 20*a*, 20*b* in the wall of the opening 20 for the insertion pipe 10 and is manufactured in a simple manner by a casting technique. Position and shape of the recesses may be chosen to suit thermodynamic requirements. The coolant may thus be specifically directed towards thermally critical areas. The insertion pipe 10 passes through the opening 20 in the intermediary deck 4.

At least one main transfer opening 22 for each cylinder is positioned in the area of a side wall 1*b* of the cylinder head 1, opposite the inlet opening 13 with regard to the longitudinal plane 23 of the engine. In order to permit venting and the escaping of vapor bubbles from the lower cooling chamber 5 even when the engine is tilted, at least one vent 8 is provided for each cylinder A, B between the longitudinal plane 23 of the engine and a side wall 1*c* of the cylinder head 1, preferably in the area of a transverse engine plane 18 through the cylinder axis 6.

Optimum cooling of the areas subject to high thermal loads, i.e., areas 30, 31 between intake passage 16 and fuel injection device 11 on the one hand and exhaust passage 17 and fuel injection device 11 on the other hand, will be obtained by locating the auxiliary transfer openings 9*a*, 9*b* in these thermally sensitive regions between intake- and exhaust passages 16, 17. A first auxiliary transfer opening 9*a* is provided in the area 31 between exhaust passage 17 and the insertion opening 20 for the fuel injection device 11, and a second auxiliary transfer opening 9*b* is provided in the area 30 between intake passage 16 and the insertion opening 20. The intake ports are indicated by 16*a*, 16*b*, the exhaust ports by 17*a*, 17*b*.

Figure 4:
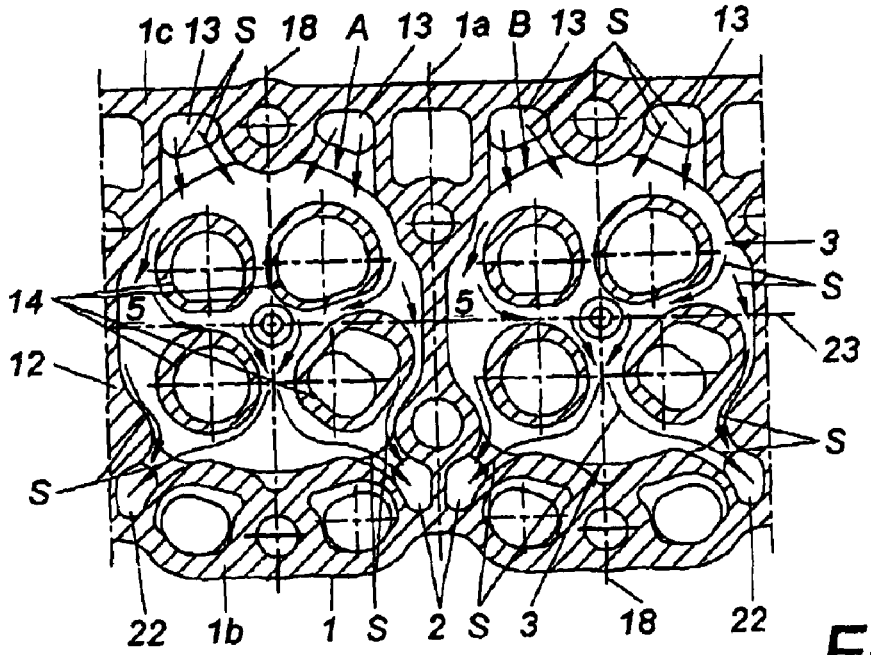
FIG. 4 shows the cylinder head in a section along line IV—IV of FIG. 3.

The coolant flows through inlet openings 13 in the area of the sidewall 1*c* of the cylinder head 1 essentially in transverse direction indicated by arrows S into the lower cooling chamber 5 (FIG. 4). The coolant flowing around the areas of the valve seats 14 of the lifting valves and of the fuel injection device 11 provides optimum cooling. From the lower cooling chamber 5 the coolant passes through the auxiliary transfer openings 9*a*, 9*b* and the main transfer opening 22 in the opposite side wall 1*b* into the upper cooling chamber 7 and flows in the longitudinal direction of the cylinder head 1 through the upper cooling chamber 7 which is designed as a single contiguous space for all cylinders A, B. Via at least one outlet opening—not shown in the drawings—the coolant leaves the cylinder head 1. The outlet opening may for instance be located at the front end of the cylinder head 1. Alternatively, the upper cooling chamber 7 may be provided with a collecting rail for the discharged coolant.

FIG. 4 shows that the lower cooling chambers 5 of two adjacent cylinders A, B are separated by a partitioning wall 12. Each of the partitioning walls 12 is located in the area of a transverse engine plane 1*a* in the cylinder head 1.

The auxiliary transfer openings 9*a*,9*b* are dimensioned in such a way that only 20% to 40% of the total coolant flow volume per cylinder A, B, for instance 30%, will flow through the auxiliary transfer openings 9*a*, 9*b*. The greater part of the coolant will enter the upper cooling chamber 7 via the main transfer opening 22. A substantial transverse flow will thus be generated in the lower cooling chamber 5 and optimum cooling of the fire deck 2 will be achieved. In order to avoid film boiling in the area between the exhaust passage and the opening for the fuel injection device a high flow velocity in this area is desirable, with preferably two thirds of the partial coolant flow volume flowing through the first auxiliary transfer opening 9*a* and one third through the second auxiliary transfer opening 9*b*. The flow cross section of the first auxiliary transfer opening 9*a* is roughly twice as large as that of the second auxiliary transfer opening 9*b*.

What is claimed is:

1. A cylinder head for a liquid-cooled internal combustion engine, with at least one intake and at least one exhaust port per cylinder, and with a cooling chamber configuration adjacent to a fire deck, which is partitioned by an intermediary deck essentially parallel to the fire deck into a lower cooling chamber next to the fire deck and an upper cooling chamber adjoining said lower cooling chamber in the direction of a cylinder axis, where lower and upper cooling chambers are flow-connected by at least one main transfer opening per cylinder in the area of a side wall of the cylinder head and by at least one auxiliary transfer opening in the region of an insertion opening for the insertion of a fuel injection device, and where at least one feeder inlet per cylinder for a cooling medium opens into the lower cooling chamber and at least one draining outlet for the cooling medium departs from the upper cooling chamber, and where a lower cooling chamber is provided for each individual cylinder, the lower cooling chambers of at least two adjacent cylinders being essentially separated by partitioning wall and the cooling medium flowing essentially transversely to the cylinder head in the lower cooling chamber, while the upper cooling chamber extends over at least two cylinders, wherein at least one a auxiliary transfer opening is configured as a recess in the insertion opening, wherein at least one first auxiliary transfer opening is located in at least one area between the intake passage and the insertion opening and/or between the exhaust passage and the insertion opening, and wherein at least two auxiliary transfer openings are provided which are configured as recesses in the insertion opening, at least one first auxiliary transfer opening being located in the area between the exhaust passage and the insertion opening and at least one second auxiliary transfer opening being located in the area between the intake passage and the insertion opening.

2. A cylinder head according to claim 1, wherein the first auxiliary transfer opening has a larger flow cross-section than the second auxiliary transfer opening.

3. A cylinder head according to claim 2, wherein the flow cross-section of the first auxiliary transfer opening is roughly twice as large as the flow cross-section of the second auxiliary transfer opening.

4. A cylinder head according to claim 1, wherein the auxiliary transfer openings are made by casting.

5. A cylinder head for a liquid-cooled internal combustion engine, with at least one intake and at least one exhaust port per cylinder, and with a cooling chamber configuration adjacent to a fire deck, which is partitioned by an intermediary deck essentially parallel to the fire deck into a lower cooling chamber next to the fire deck and an upper cooling chamber adjoining said lower cooling chamber in the direction of a cylinder axis, where lower and upper cooling chambers are flow-connected by at least one main transfer opening per cylinder in the area of a side wall of the cylinder head and by at least one auxiliary transfer opening in the region of an insertion opening for the insertion of a fuel injection device, and where at least one feeder inlet per cylinder for a cooling medium opens into the lower cooling chamber and at least one draining outlet for the cooling medium departs from the upper cooling chamber, and where a lower cooling chamber is provided for each individual cylinder, the lower cooling chambers of at least two adjacent cylinders being essentially separated by partitioning wall and the cooling medium flowing essentially transversely to the cylinder head in the lower cooling chamber, while the upper cooling chamber extends over at least two cylinders, wherein at least one auxiliary transfer opening is configured as a recess in the insertion opening, wherein at least one first auxiliary transfer opening is located in at least one area between the intake passage and the insertion opening and/or between the exhaust passage and the insertion opening, and wherein at least two auxiliary transfer openings are located diametrically opposite each other with respect to the insertion opening.

6. A cylinder head according to claim 5, wherein the first auxiliary transfer opening has a larger flow cross-section than the second auxiliary transfer opening.

7. A cylinder head according to claim 6, wherein the flow cross-section of the first auxiliary transfer opening is roughly twice as large as the flow cross-section of the second auxiliary transfer opening.

8. A cylinder head for a liquid-cooling internal combustion engine, with at least one intake and at least one exhaust port per cylinder, and with a cooling chamber configuration adjacent to a fire deck, which is partitioned by an intermediary deck essentially parallel to the fire deck into a lower cooling chamber next to the fire deck and an upper cooling chamber adjoining said lower cooling chamber in the direction of a cylinder axis, where lower and upper cooling chambers are flow-connected by at least one main transfer opening per cylinder in the area of a side wall of the cylinder head and by at least one auxiliary transfer opening in the region of an insertion opening for the insertion of a fuel injection device, and where at least one feeder inlet per cylinder for a cooling medium opens into the lower cooling chamber and at least one draining outlet for the cooling medium departs from the upper cooling chamber, and where a lower cooling chamber is provided for each individual cylinder, the lower cooling chambers of at least two adjacent cylinders being essentially separated by a partitioning wall and the cooling medium flowing essentially transversely to the cylinder head in the lower cooling chamber, while the upper cooling chamber extends over at least two cylinders, wherein at least one auxiliary transfer opening is configured as a recess in the insertion opening, wherein at least one first auxiliary transfer opening is located in at least one area between the intake passage and the insertion opening and/or between the exhaust passage and the insertion opening, and wherein 20% to 40% of the total coolant volume passing through upper and lower coolant chambers will flow through the auxiliary transfer opening.

9. A cylinder head for a liquid-cooled internal combustion engine, with at least one intake and at least one exhaust port per cylinder, and with a cooling chamber configuration adjacent to a fire deck, which is partitioned by an intermediary deck essentially parallel to the fire deck into a lower cooling chamber next to the fire deck and an upper cooling chamber adjoining said lower cooling chamber in the direction of a cylinder axis, where lower and upper cooling chambers are flow-connected by at least one main transfer opening per cylinder in the area of a side wall of the cylinder head and by at least one auxiliary transfer opening in the region of an insertion opening for the insertion of a fuel injection device, and where at least one feeder inlet per cylinder for a cooling medium opens into the lower cooling chamber and at least one draining outlet for the cooling medium departs from the upper cooling chamber, and where a lower cooling chamber is provided for each individual cylinder, the lower cooling chambers of at least two adjacent cylinders being essentially separated by a partitioning wall and the cooling medium flowing essentially transversely to the cylinder head in the lower cooling chamber, while the upper cooling chamber extends over at least two cylinders, wherein at least one auxiliary transfer opening is configured as a recess in the insertion opening, wherein at least one first auxiliary transfer opening is located in at least one area between the intake passage and the insertion opening and/or between the exhaust passage and the insertion opening, and wherein two thirds of the partial flow volume will pass from lower to upper cooling chamber via a first auxiliary transfer opening, and one third of the partial flow volume will pass via the second auxiliary transfer opening.

* * * * *